US011453539B1

(12) United States Patent
Phillips

(10) Patent No.: US 11,453,539 B1
(45) Date of Patent: Sep. 27, 2022

(54) LAUNDRY TOTE WITH MULTIPLE ATTACHMENTS

(71) Applicant: Theresa Phillips, Freeport, NY (US)

(72) Inventor: Theresa Phillips, Freeport, NY (US)

( * ) Notice: Subject to any disclaimer, the term of this patent is extended or adjusted under 35 U.S.C. 154(b) by 335 days.

(21) Appl. No.: 16/662,812

(22) Filed: Oct. 24, 2019

Related U.S. Application Data

(60) Provisional application No. 62/766,512, filed on Oct. 24, 2018.

(51) Int. Cl.
*B65D 71/54* (2006.01)
*A45C 13/02* (2006.01)

(52) U.S. Cl.
CPC ..... *B65D 71/0011* (2013.01); *A45C 13/02* (2013.01)

(58) Field of Classification Search
CPC ..... B65F 71/0011; B65F 21/0201; B65F 21/0202; B65F 21/0204; B65F 21/0205; A45C 13/02; B65D 71/0011; B65D 21/0201; B65D 21/0202; B65D 21/0204; B65D 21/0205
USPC ..... 206/576, 499, 756, 216, 223, 775, 504
See application file for complete search history.

(56) References Cited

U.S. PATENT DOCUMENTS 3,433,383 A * 3/1969 Phibbs ..... B65D 25/00 206/568
3,842,976 A * 10/1974 Dea ..... B65D 1/24 206/811
3,893,607 A 7/1975 Jones
4,094,351 A 6/1978 Catenaccio
5,050,755 A * 9/1991 Strawder ..... B65D 21/0202 220/909
5,050,998 A 9/1991 Wachtel
5,454,478 A * 10/1995 Everson ..... B65D 25/107 220/528
5,458,278 A 10/1995 LaConte
5,503,476 A 4/1996 Hamdan
5,690,217 A 11/1997 Friday
5,890,613 A * 4/1999 Williams ..... A45C 7/0045 220/23.4
5,961,216 A * 10/1999 Quinn ..... A45C 13/02 206/581
6,659,273 B1 12/2003 Scola
6,761,367 B2 7/2004 Fite
7,552,825 B2 6/2009 Caporrino
7,950,522 B2 * 5/2011 Slayton ..... A61F 15/001 206/229
8,381,936 B1 * 2/2013 Blake ..... D06F 95/002 220/500
2003/0044323 A1 * 3/2003 Diamond ..... G01N 35/10 211/74
2009/0090647 A1 * 4/2009 Panchal ..... B65D 21/0231 206/509
2010/0089850 A1 * 4/2010 Hovatter ..... B01L 9/06 211/85.18
2012/0292327 A1 * 11/2012 Carey ..... A45C 13/02 220/592.2
2015/0122808 A1 * 5/2015 Trask ..... F25D 25/005 220/4.27

(Continued)

*Primary Examiner* — Chun Hoi Cheung
(74) *Attorney, Agent, or Firm* — Cramer Patent & Design, PLLC; Aaron R. Cramer

(57) ABSTRACT

A laundry tote having multiple attachments utilizes a base, a drawer, and a plurality of interlocking snap fit liquid receptacles. Each inward surface of the device has attachment points yielding a modular and customizable laundry tote.

15 Claims, 6 Drawing Sheets

(56) References Cited

U.S. PATENT DOCUMENTS

| | | | | |
|---|---|---|---|---|
| 2017/0196330 | A1* | 7/2017 | Watson | A45C 13/02 |
| 2018/0271272 | A1* | 9/2018 | Smith | A47B 31/02 |

* cited by examiner

LAUNDRY TOTE WITH MULTIPLE ATTACHMENTS

RELATED APPLICATIONS

The present invention is a continuation of, was first described in, and claims the benefit of U.S. Provisional Application No. 62/766,512 filed Oct. 24, 2018, the entire disclosures of which are incorporated herein by reference.

FIELD OF THE INVENTION

The present invention relates generally to the field of a laundry tote with multiple attachments.

BACKGROUND OF THE INVENTION

Laundry refers to the washing of clothing and other textiles. Laundry processes are often done in a room reserved for that purpose; in an individual home this is referred to as a laundry room or utility room. An apartment building or student hall of residence may have a shared laundry facility. A stand-alone business is referred to as a self-service laundry. The material that is being washed, or has been laundered, is also generally referred to as laundry.

Laundry has been part of history since humans began to wear clothes, so the methods by which different cultures have dealt with this universal human need are of interest to several branches of scholarship. Laundry work has traditionally been highly gendered, with the responsibility in most cultures falling to women (known as laundresses or washerwomen). The Industrial Revolution gradually led to mechanized solutions to laundry work, notably the washing machine and later the tumble dryer. Laundry, like cooking and childcare, is done both at home and by commercial establishments outside the home.

Novice users of modern laundry machines sometimes experience accidental shrinkage of garments, especially when applying heat. For wool garments, this is due to scales on the fibers, which heat and agitation cause to stick together. In cold countries they dry it with their fireplaces, others just have many or buy more garments in preparation for winter or cold times. Other fabrics are stretched by mechanical forces during production and can shrink slightly when heated (though to a lesser degree than wool). Some clothes are "pre-shrunk" to avoid this problem.

Another common problem is color bleeding. For example, washing a red shirt with white underwear can result in pink underwear. Often only similar colors are washed together to avoid this problem, which is lessened by cold water and repeated washings. Sometimes this blending of colors is seen as a selling point, as with madras cloth. Many items are used in the laundry cycle, these include detergent, bleach, fabric softener, etc.

Laundry detergent, or washing powder, is a type of detergent (cleaning agent) that is added for cleaning laundry. While detergent is still sold in powdered form, liquid detergents have been taking major market shares in many countries since their introduction in the 1950s.

Bleach is the generic name for any chemical product which is used industrially and domestically to clean, to lighten hair color and to remove stains. It often refers, specifically, to a dilute solution of sodium hypochlorite, also called "liquid bleach". Bleaches work by reacting with many colored organic compounds, such as natural pigments, and turning them into colorless ones. While most bleaches are oxidizing agents (chemicals that can remove electrons from other molecules), some are reducing agents (that donate electrons). Chlorine, a powerful oxidizer, is the active agent in many household bleaches. Since pure chlorine is a toxic corrosive gas, these products usually contain hypochlorite which releases chlorine when needed. "Bleaching powder" usually means a formulation containing calcium hypochlorite. Oxidizing bleaching agents that do not contain chlorine are usually based on peroxides such as hydrogen peroxide, sodium percarbonate, and sodium perborate. These bleaches are called 'non-chlorine bleach,' 'oxygen bleach' or 'color-safe bleach.

A fabric softener (or conditioner) is a conditioner that is typically applied to laundry during the rinse cycle in a washing machine. In contrast to laundry detergents, fabric softeners may be regarded as a kind of after-treatment laundry aid.

When these items to be used in doing laundry are transported, there are general issues and problems that can arise. Some of those are the spilling of the products which can cause issues with the floor, user's clothing, etc., excessive amounts of items when being used, missing a small entry point in a washer, failure to carry more than one or two of the items at a time causing multiple trips, forgetting items, etc.

In light of the foregoing, there is a need to have a device which can address the forgoing problems and others that may arise.

SUMMARY OF THE INVENTION

The principles of the present invention provide for a cubic multi-purpose laundry tote device comprises a cubic tote container having a cubic tote container front, a cubic tote container first side, a cubic tote container second side, a cubic tote container back, a cubic tote container bottom, a cubic tote container interior, a cubic tote carrying strap, a cubic tote drawer, and a plurality of tote compartments. The cubic tote drawer is accessible from the cubic tote container front centrally located on the front surface of the cubic tote drawer and has a cubic tote drawer handle. The cubic tote drawer is slidably retained within the cubic tote container front with a pair of cubic tote drawer slides, each of the pair of cubic tote drawer slides are located on the inner surfaces of the cubic tote container front.

The device also comprises a cubic tote strap having a first end and a second end. The first end of the cubic tote strap is removably coupled to a cubic tote container first side top by a cubic tote first coupling device. The second end of the cubic tote strap is removably coupled to a cubic tote container second side top by a cubic tote second coupling device.

The device also comprises a cubic tote first vessel having a cubic tote first vessel lid, a cubic tote first vessel back, a cubic tote first vessel bottom, a cubic tote first vessel front, a cubic tote first vessel top, a cubic tote first vessel first side, and a cubic tote first vessel second side. A plurality of cubic tote first vessel second snap portions is configured to be coupled to the cubic tote first vessel bottom and on the cubic tote first vessel back. A plurality of cubic tote first vessel receiver portions are located on the cubic tote first vessel first side. The second snap portions on the cubic tote first vessel bottom and cubic tote first vessel back are configured to align and securely couple with the cubic tote first snap portions of the cubic tote first compartment. The receiver portions on the cubic tote first vessel first side are configured to align and securely couple with the second snap portions of the cubic tote second vessel. The cubic tote first vessel lid is removably coupled to the cubic tote first vessel top, when coupled the cubic tote first vessel lid provides for contents of the cubic tote first vessel to be secure and not to exit therefrom. The cubic tote first vessel is capable of being removable from the cubic tote container. The cubic tote first vessel is a rectangular prism.

The device also comprises a cubic tote second vessel having a cubic tote second vessel lid, a cubic tote second vessel back, a cubic tote second vessel bottom, a cubic tote second vessel front, a cubic tote second vessel top, a cubic tote second vessel first side, and a cubic tote second vessel second side. A plurality of cubic tote second vessel second snap portions are configured to be coupled to the cubic tote second vessel bottom, on the cubic tote second vessel back, on the cubic tote second vessel first side, and on the cubic tote first vessel second side. The second snap portions on the cubic tote second vessel bottom and cubic tote second vessel back are configured to align and securely couple with the cubic tote first snap portions of the cubic tote second compartment. The second snap portions on the cubic tote second vessel first side and cubic tote second vessel second side are configured to align and securely couple with the receiver portions of the cubic tote first vessel and the receiver portions of the cubic tote third vessel. The cubic tote second vessel lid is removably coupled to the cubic tote second vessel top. When coupled, the cubic tote second vessel lid provides for contents of the cubic tote second vessel to be secure and not to exit therefrom. The cubic tote second vessel is a rectangular prism.

The device also comprises a cubic tote third vessel having a cubic tote third vessel lid, a cubic tote third vessel back, a cubic tote third vessel bottom, a cubic tote third vessel front, a cubic tote third vessel top, a cubic tote third vessel first side, and a cubic tote third vessel second side. A plurality of cubic tote third vessel second snap portions are configured to be coupled to the cubic tote third vessel bottom and on the cubic tote third vessel back. A plurality of cubic tote third vessel receiver portions are located on the cubic tote third vessel second side. The second snap portions on the cubic tote third vessel bottom and cubic tote third vessel back are configured to align and securely couple with the cubic tote first snap portions of the cubic tote third compartment. The receiver portions on the cubic tote third vessel second side are configured to align and securely couple with the second snap portions of the cubic tote second vessel. The cubic tote third vessel lid is removably coupled to the cubic tote third vessel top. When coupled, the cubic tote third vessel lid provides for contents of the cubic tote third vessel to be secure and not to exit therefrom. The cubic tote third vessel is a rectangular prism.

The cubic tote compartments may be configured in the cubic tote interior and each of the cubic tote compartments have a plurality of cubic tote first snap portions, An individual cubic tote first snap portion receives and mates with an individual second snap portion of the cubic tote first vessel, the cubic tote second vessel, and the cubic tote third vessel respectively. The cubic tote first vessel may reside within the cubic tote first compartment, the cubic tote second vessel resides within the cubic tote second compartment, and the cubic tote third vessel resides within the cubic tote third compartment. The cubic tote container may be made of material selected from the group consisting of hard-plastic, poly-vinyl chloride, or aluminum. The front surface of the cubic tote drawer may have a cubic tote drawer descriptor. The cubic tote strap is a strap which may be made of material selected from the group consisting of vinyl, plastic, and cloth. The cubic tote first vessel may be made of material selected from the group consisting of hard-plastic, poly-vinyl chloride, or aluminum. The cubic tote first vessel may be a cubic tote drawer descriptor. The cubic tote second vessel may be a cubic tote drawer descriptor. The cubic tote third vessel may be a cubic tote drawer descriptor. The cubic tote first vessel may be a bottle-shaped device. The cubic tote first vessel may include a bottom section relatively shaped as a rectangular prism and is tapering upwards to an open top favoring a leftmost side. The cubic tote second vessel may be a bottle-shaped device. The cubic tote first vessel may include a bottom section relatively shaped as a rectangular prism and is tapering upwards to an open top favoring a rightmost side. The cubic tote second vessel lid may be removably coupled to a spout of the tapered portion of the cubic tote second vessel top. The cubic tote third vessel lid is removably coupled to a spout of the tapered portion of the cubic tote third vessel top. The cubic tote container may have a length selected from the group consisting of 10 inches, 12 inches, or 18 inches. The cubic tote container may have a width selected from the group consisting of 10 inches, 12 inches, or 18 inches. The cubic tote container may have a height selected from the group consisting of 16 inches, 19 inches, or 20 inches.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
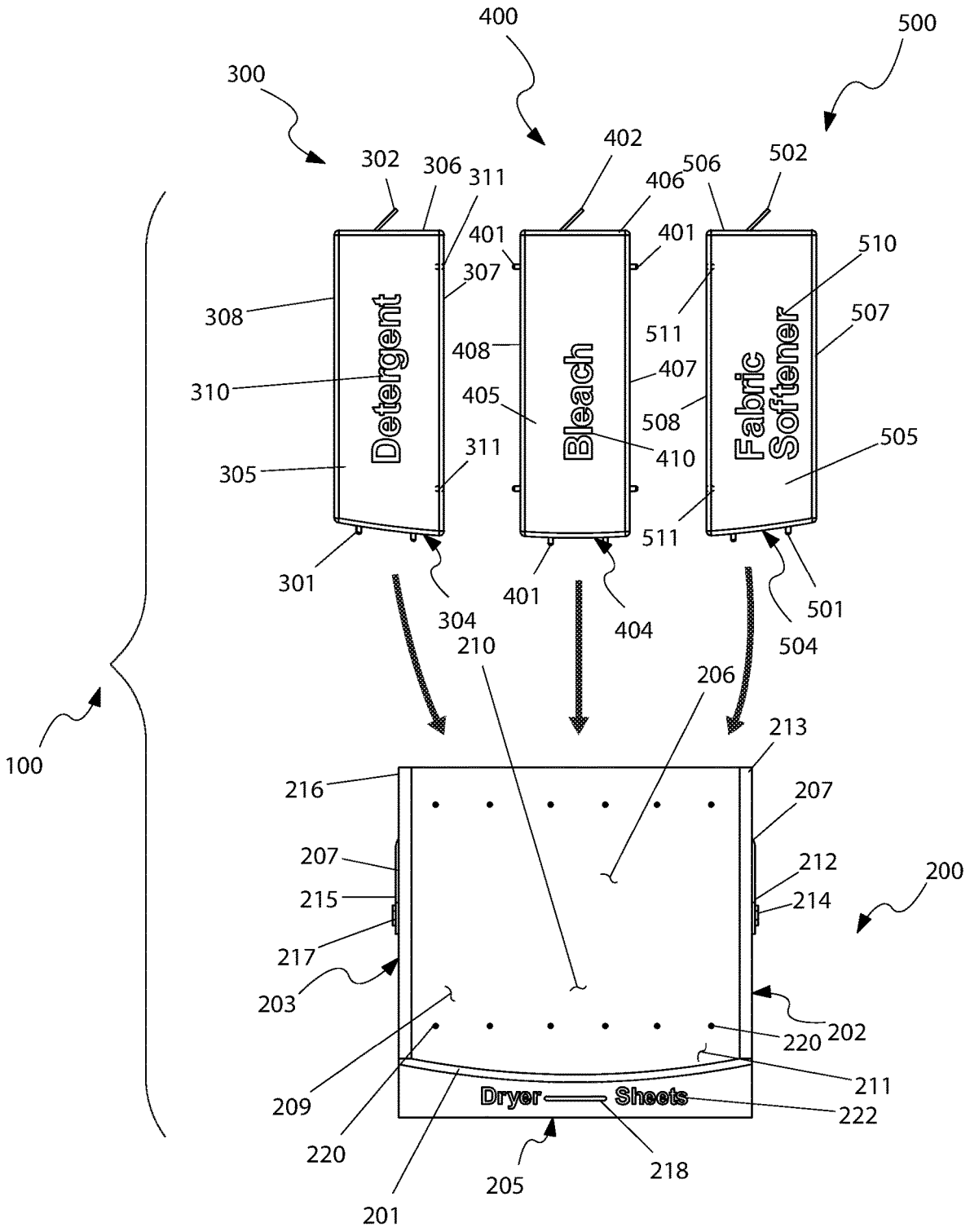
FIG. 1 is an illustrated view of an exemplary cubic multi-purpose laundry tote 100 in a disassembled configuration.

100 cubic multi-purpose laundry tote
150 alternate multi-purpose laundry tote
200 cubic tote container
201 cubic tote container front
202 cubic tote container first side
203 cubic tote container second side
204 cubic tote container back
205 cubic tote container bottom
206 cubic tote container interior
207 cubic tote strap
208 cubic tote drawer
209 cubic tote first compartment
210 cubic tote second compartment
211 cubic tote third compartment
212 cubic tote strap first end
213 cubic tote container first side top
214 cubic tote first coupling device

215 cubic tote strap second end
216 cubic tote container second side top
217 cubic tote second coupling device
218 cubic tote drawer handle
219 cubic tote drawer slide
220 cubic tote first snap portion
222 cubic tote drawer descriptor
250 alternate tote container
251 alternate tote container front
252 alternate tote container first side
253 alternate tote container second side
254*a* alternate tote container back bottom section
254*b* alternate tote container back top section
255 alternate tote container bottom
256 alternate tote container interior
257 alternate tote strap
258 alternate tote drawer
259 alternate tote first compartment
260 alternate tote second compartment
261 alternate tote third compartment
262 alternate tote strap first end
264 alternate tote first coupling device
265 alternate tote strap second end
267 alternate tote second coupling device
268 alternate tote drawer handle
269 alternate tote drawer slide
270 alternate tote first snap portion
272 alternate tote drawer descriptor
300 cubic tote first vessel
301 cubic tote first vessel second snap portion
302 cubic tote first vessel lid
303 cubic tote first vessel back
304 cubic tote first vessel bottom
305 cubic tote first vessel front
306 cubic tote first vessel top
307 cubic tote first vessel first side
308 cubic tote first vessel second side
310 cubic tote first vessel descriptor
311 cubic tote first vessel receiver portion
300 cubic tote first vessel
351 alternate tote first vessel second snap portion
352 alternate tote first vessel lid
353 alternate tote first vessel back
354 alternate tote first vessel bottom
355 alternate tote first vessel front
356 alternate tote first vessel top
357 alternate tote first vessel first side
358 alternate tote first vessel second side
360 alternate tote first vessel descriptor
400 cubic tote second vessel
401 cubic tote second vessel second snap portion
402 cubic tote second vessel lid
403 cubic tote second vessel back
404 cubic tote second vessel bottom
405 cubic tote second vessel front
406 cubic tote second vessel top
407 cubic tote second vessel first side
408 cubic tote second vessel second side
410 cubic tote second vessel descriptor
450 alternate tote second vessel
451 alternate tote second vessel second snap portion
452 alternate tote second vessel lid
453 alternate tote second vessel back
454 alternate tote second vessel bottom
455 alternate tote second vessel front
456 alternate tote second vessel top
457 alternate tote second vessel first side
458 alternate tote second vessel second side
460 alternate tote second vessel descriptor
500 cubic tote third vessel
501 cubic tote third vessel second snap portion
502 cubic tote third vessel lid
503 cubic tote third vessel back
504 cubic tote third vessel bottom
505 cubic tote third vessel front
506 cubic tote third vessel top
507 cubic tote third vessel first side
508 cubic tote third vessel second side
510 cubic tote third vessel descriptor
511 cubic tote third vessel receiver portion
550 alternate tote third vessel
551 alternate tote third vessel second snap portion
552 alternate tote third vessel lid
553 alternate tote third vessel back
554 alternate tote third vessel bottom
555 alternate tote third vessel front
556 alternate tote third vessel top
557 alternate tote third vessel first side
558 alternate tote third vessel second side
560 alternate tote third vessel descriptor

DESCRIPTION OF THE PREFERRED EMBODIMENTS

Figure 2:
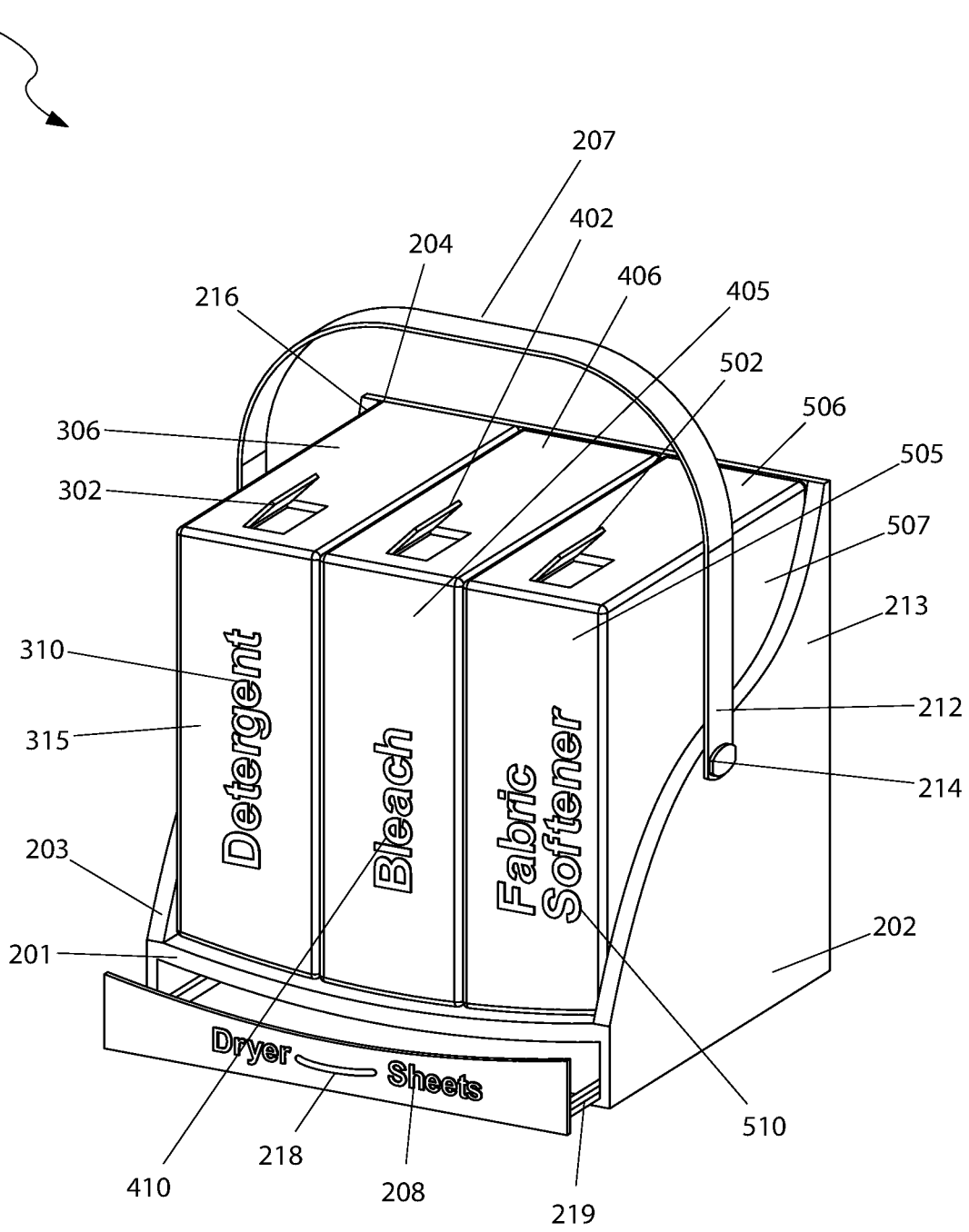
FIG. 2 is a front perspective view of the exemplary cubic multi-purpose laundry tote 100 in an assembled configuration.
Figure 3:
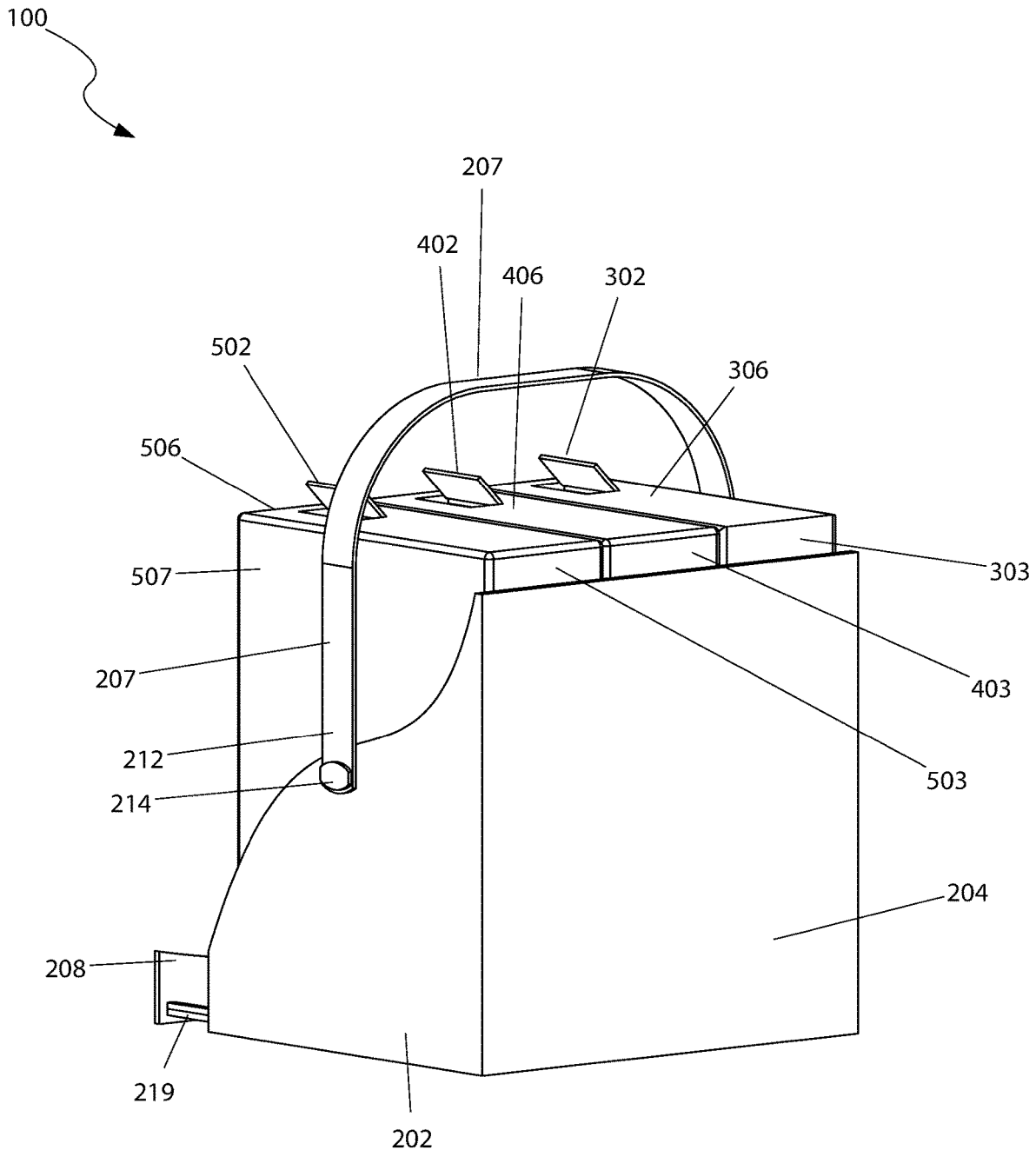
FIG. 3 is a rear perspective view of the exemplary cubic multi-purpose laundry tote 100 in an assembled configuration.
Figure 4:
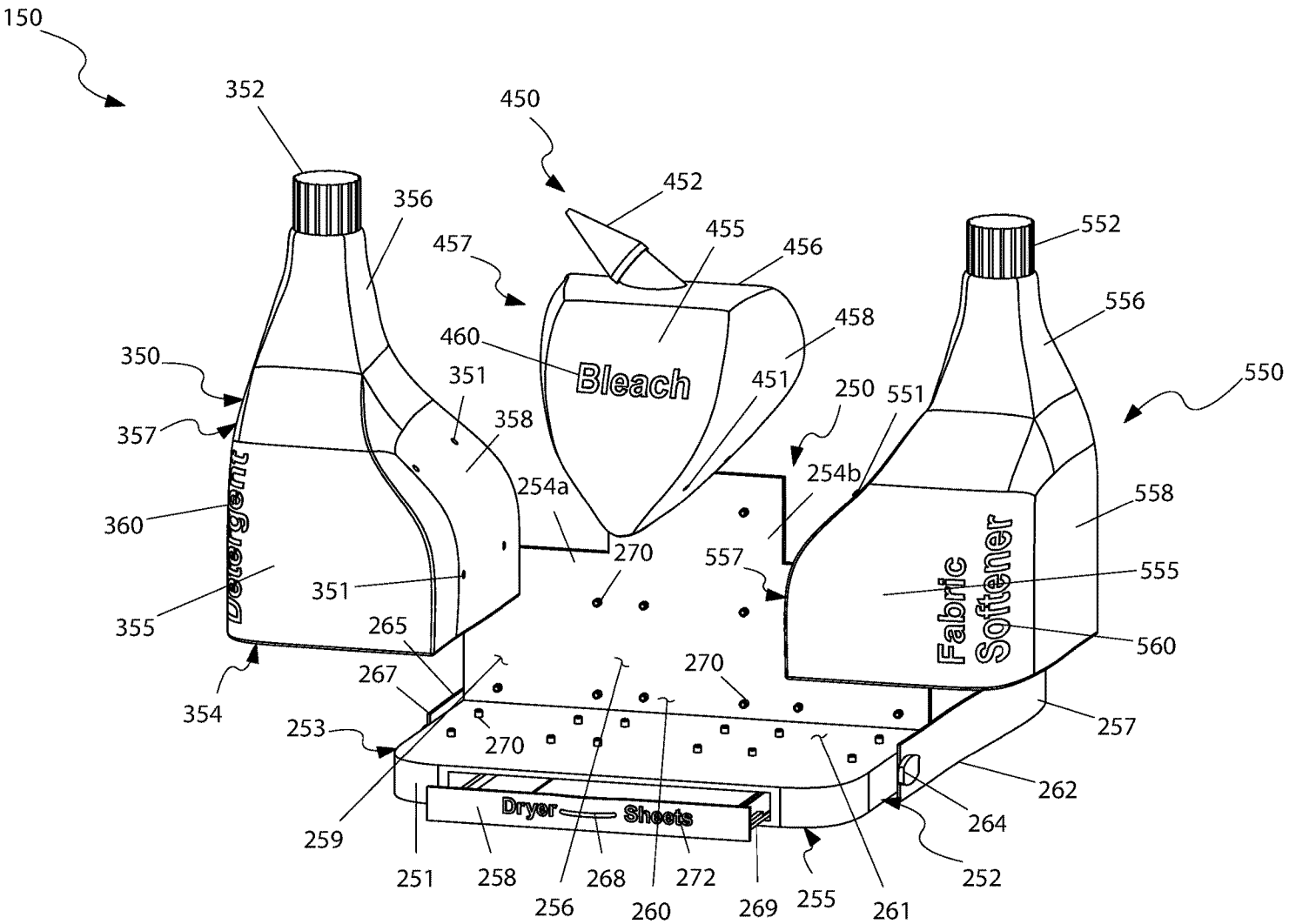
FIG. 4 is an illustrated view of an alternate multi-purpose laundry tote 150 in a disassembled configuration.
Figure 5:
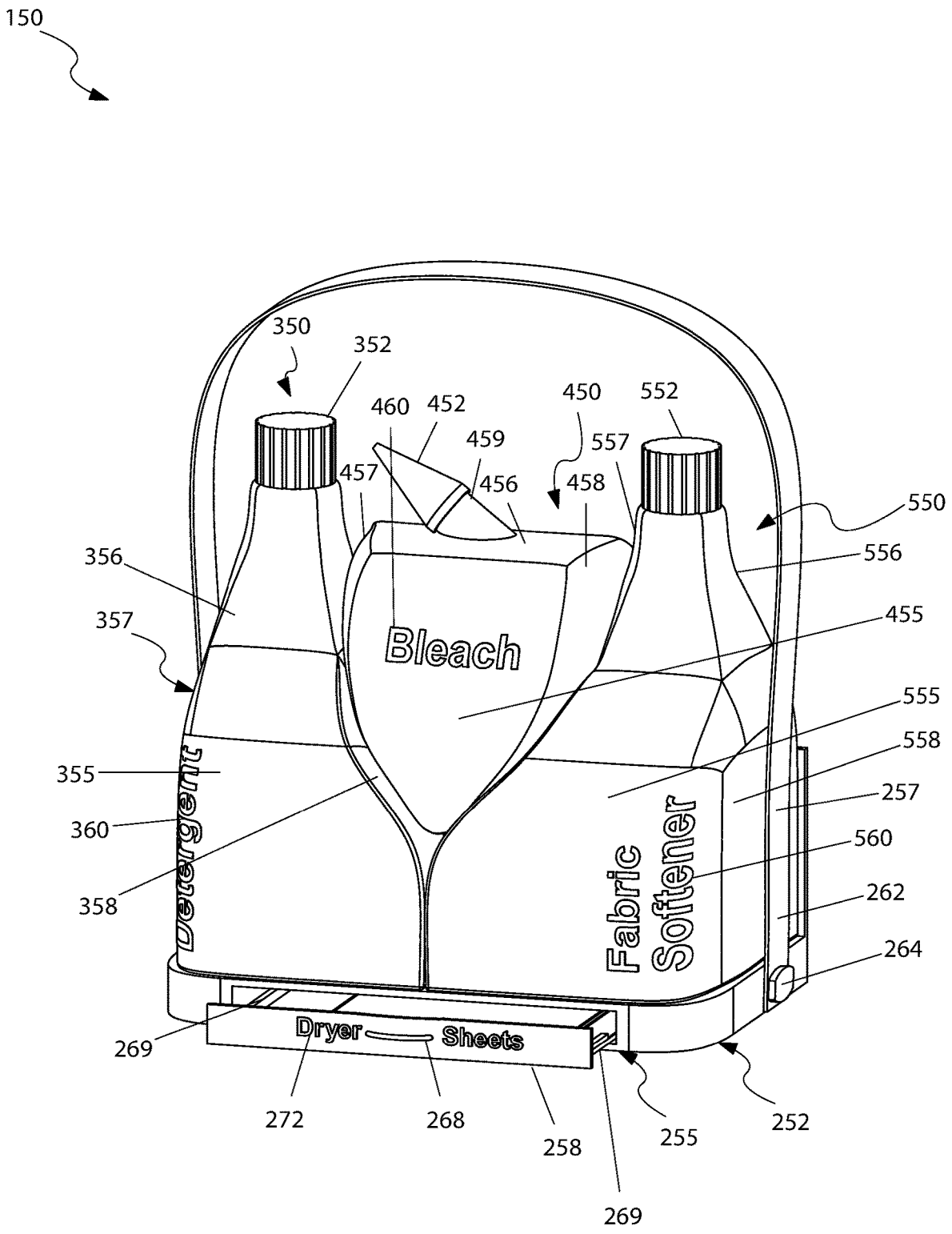
FIG. 5 is a front perspective view of the alternate multi-purpose laundry tote 150 in an assembled configuration; and, FIG. 6 is a rear perspective view of the alternate multi-purpose laundry tote 150 in an assembled configuration.
Figure 6:
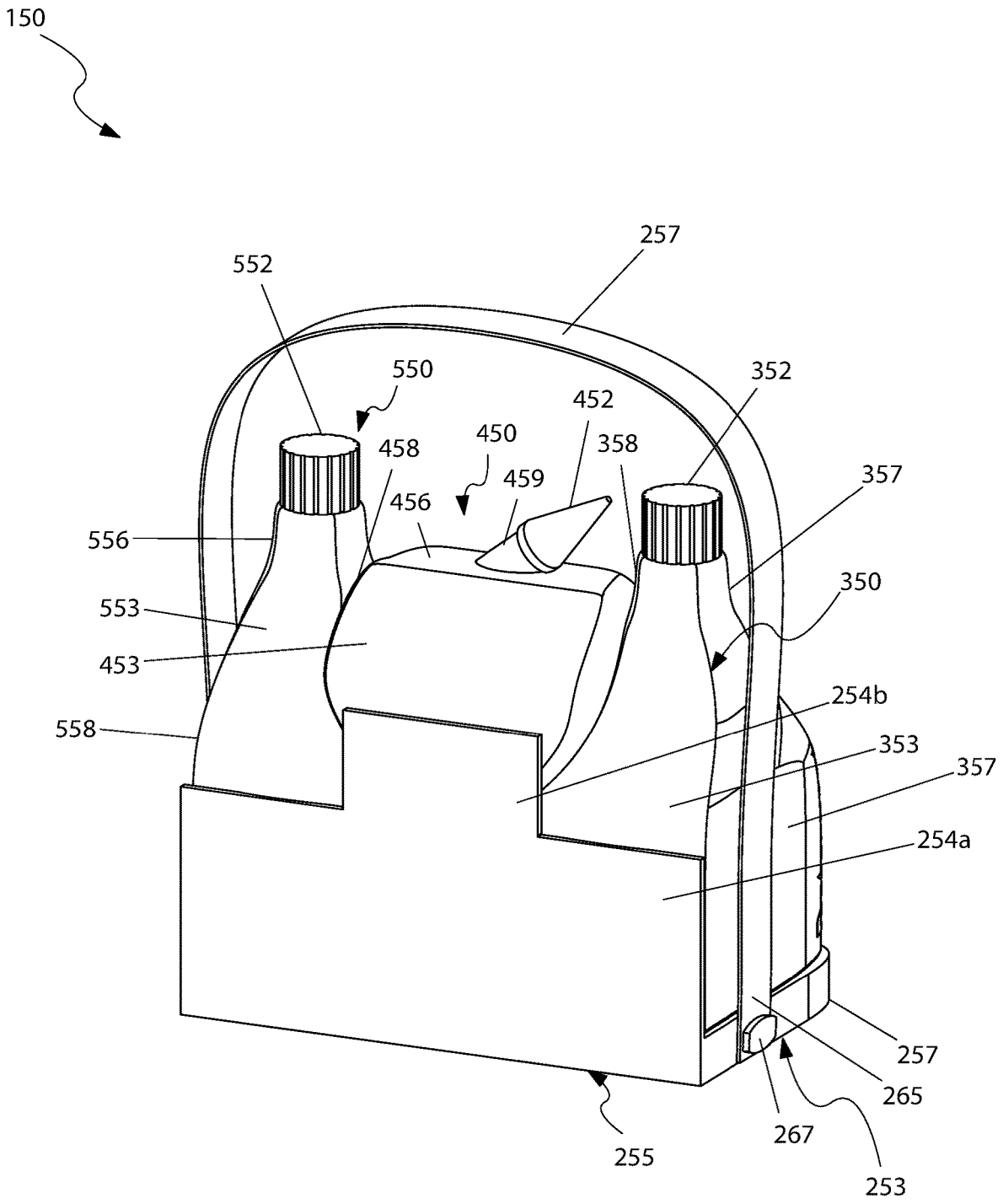

The best mode for carrying out the invention is presented in terms of its preferred embodiment, herein depicted within FIGS. 1 through 3 and in an alternate embodiment, within FIGS. 4 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

The phrases "in one (1) embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

"Above," "adhesive," "affixing," "any," "around," "both," "bottom," "by," "comprising," "consistent," "customized," "enclosing," "friction," "in," "labeled," "lower," "magnetic," "marked," "new," "nominal," "not," "of," "other," "outside," "outwardly," "particular," "permanently," "preventing," "raised," "respectively," "reversibly," "round," "square," "substantial," "supporting," "surrounded," "surrounding," "threaded," "to," "top," "using," "wherein," "with," or other such descriptors herein are used in their normal yes-or-no sense, not as terms of degree, unless context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

Referring to FIGS. 1-3, an illustrated view of an exemplary multi-purpose laundry tote 100 for carrying laundry supplies is presented. When completely assembled (as seen in FIGS. 2 and 3), it has a general overall cubic shape and herein will be described as the cubic tote 100. The cubic tote 100 is useful for providing a secure handling of the laundry supplies, such as bleach, detergent, fabric softener, etc. when being transported to a from a laundry facility. The cubic tote 100 is further useful for providing an efficient method to have laundry supplies available when doing laundry without having additional effort made to obtain the laundry supplies and to prevent the laundry supplies from being spilled on clothing, the floor, into the laundry washer, etc.

The cubic tote 100 has a cubic tote container 200, a cubic tote first vessel 300, a cubic tote second vessel 400 and a cubic tote third vessel 500. The cubic tote container 200 preferably has a length of twelve inches (12 in.); however other lengths are hereby contemplated, including, but not limited to: ten inches (10 in.), eighteen inches (18 in.), etc. The cubic tote container 200 preferably has a width of twelve inches (12 in.); however other widths are hereby contemplated, including, but not limited to: ten inches (10 in.), eighteen (18) inches, etc. The cubic tote container 200 of the cubic tote 100 is preferably a cubic shape; however other shapes are hereby contemplated, including but not limited to: rectangular, trapezoidal, etc. and represent different embodiments of the overall invention. The cubic tote container 200 preferably has a length of twelve inches (12 in.), however other lengths are hereby contemplated, including, but not limited to: ten inches (10 in.), eighteen inches (18 in.), etc. The cubic tote container 200 is preferably made of a hard-plastic material; however other materials are hereby contemplated, including, but not limited to, polyvinyl chloride (PVC), aluminum, etc.

The cubic tote container 200 has a cubic tote container front 201, a cubic tote container first side 202, a cubic tote container second side 203, a cubic tote container back 204, a cubic tote container bottom 205, a cubic tote container interior 206, a cubic tote carrying strap 207, a cubic tote drawer 208 and a plurality of cubic tote compartments (first compartment) 209, (second compartment) 210, (third compartment) 211. The cubic tote container front 201 is preferably four inches (4 in.) in height; however other heights are hereby contemplated, including but not limited to, three inches (3 in.), five inches (5 in.), etc. The cubic tote container back 204 preferably has a height of nineteen inches (19 in.), however other heights are hereby contemplated, including, but not limited to, sixteen inches (16 in.), twenty inches (20 in.), etc.

A cubic tote strap first end 212 of the cubic tote strap 207 is removably coupled to a cubic tote container first side top 213 by a cubic tote first coupling device 214. A cubic tote strap second end 215 of the cubic tote strap 207 is removably coupled to a cubic tote container second side top 216 by a cubic tote second coupling device 217. The cubic tote strap 207 is preferably made of a vinyl material; however, other materials are hereby contemplated, including, but not limited to: plastic, cloth, etc.

The cubic tote drawer 208 is accessible from the cubic tote container front 201. Centrally located on the front surface of the cubic tote drawer 208 is a cubic tote drawer handle 218. The cubic tote drawer 208 is preferably slidably retained within the cubic tote container front 201 with a pair of cubic tote drawer slides 219, each located on the inner surfaces of the cubic tote container front 201. Other means of slidably attaching or otherwise removably affixing the cubic tote drawer 208 to the cubic tote container front 201 can include a hinge coupler, etc. The cubic tote drawer 208 preferably holds fabric softener sheets; however, other items to be held are hereby contemplated, including, but not limited to: clothespins, buttons, etc. Optionally and/or additionally, the front surface of the cubic tote drawer 208 has a cubic tote drawer descriptor 222. The cubic tote drawer descriptor 222 is preferably "Dryer Sheets", however any other type of indicia has been contemplated by this application.

The plurality of cubic tote compartments 209, 210, 211 are configured in the cubic tote interior 208. Each of the cubic tote compartments 209, 210, 211 have a plurality of cubic tote first snap portions 220. An individual cubic tote first snap portion 220 can receive and mate with an individual second snap portion 301, 401, 501 of the cubic tote first vessel 300, the cubic tote second vessel 400, and the cubic tote third vessel 500, respectively. The cubic tote first vessel 300 resides within the cubic tote first compartment 209, the cubic tote second vessel 400 resides within the cubic tote second compartment 210, and the cubic tote third vessel 500 resides within the cubic tote third compartment 211.

The cubic tote first vessel 300 is preferably a rectangular prism having a height of nineteen inches (19 in.); however, other heights are hereby contemplated, including, but not limited to: eighteen inches (18 in.), twenty inches (20 in.), etc. The cubic tote first vessel 300 preferably has a length of twelve inches (12 in.); however, other lengths are hereby contemplated, including, but not limited to: ten inches (10 in.), fourteen inches (14 in.), etc. The cubic tote first vessel 300 preferably has a width of four inches (4 in.); however, other widths are hereby contemplated, including, but not limited to: three inches (3 in.), five inches (5 in.), etc. The cubic tote first vessel 300 is preferably made of a hard-plastic material; however other materials are hereby contemplated, including, but not limited to: PVC, aluminum, etc.

The cubic tote first vessel 300 further has a cubic tote first vessel lid 302, a cubic tote first vessel back 303, a cubic tote first vessel bottom 304, a cubic tote first vessel front 305, a cubic tote first vessel top 306, a cubic tote first vessel first side 307, and a cubic tote first vessel second side 308. A plurality of cubic tote first vessel second snap portions 301 is configured to be coupled to the cubic tote first vessel bottom 304 and on the cubic tote first vessel back 303. A plurality of cubic tote first vessel receiver portions 311 are located on the cubic tote first vessel first side 307. The second snap portions 301 on the cubic tote first vessel bottom 304 and cubic tote first vessel back 303 are configured to align and securely couple with the cubic tote first snap portions 220 of the cubic tote first compartment 209. The receiver portions 311 on the cubic tote first vessel first side 307 are configured to align and securely couple with the second snap portions 401 of the cubic tote second vessel 400.

The cubic tote first vessel lid 302 is removably coupled to the cubic tote first vessel top 306. When coupled, the cubic tote first vessel lid 302 provides for contents of the cubic tote first vessel 300 to be secure and not to exit therefrom. The contents are preferably a detergent. The detergent preferably is a liquid detergent, but other types of detergent are hereby contemplated, including, but not limited to: "pods", powder, etc. The cubic tote first vessel 300 is capable of being removable from the cubic tote container 200.

Optionally and/or additionally, the cubic tote first vessel front 305 has a cubic tote first vessel descriptor 310. The cubic tote first vessel descriptor 310 is preferably "Detergent"; however, any other descriptor has been contemplated by this application.

The cubic tote second vessel 400 is preferably a rectangular prism having a height of nineteen inches (19 in.); however, other heights are hereby contemplated, including, but not limited to: eighteen inches (18 in.), twenty inches (20 in.), etc. The cubic tote second vessel 400 preferably has a length of twelve inches (12 in.); however, other lengths are hereby contemplated, including, but not limited to: ten inches (10 in.), fourteen inches (14 in.), etc. The cubic tote second vessel 400 preferably has a width of four inches (4 in.); however, other widths are hereby contemplated, including, but not limited to: three inches (3 in.), five inches (5 in.), etc. The cubic tote second vessel 400 is preferably made of a hard-plastic material; however, other materials are hereby contemplated, including, but not limited to: PVC, aluminum, etc.

The cubic tote second vessel 400 further has a cubic tote second vessel lid 402, a cubic tote second vessel back 403, a cubic tote second vessel bottom 404, a cubic tote second vessel front 405, a cubic tote second vessel top 406, a cubic tote second vessel first side 407, and a cubic tote second vessel second side 408. A plurality of cubic tote second vessel second snap portions 401 is configured to be coupled to the cubic tote second vessel bottom 404, on the cubic tote second vessel back 403, on the cubic tote second vessel first side 407, and on the cubic tote first vessel second side 408. The second snap portions 401 on the cubic tote second vessel bottom 404 and cubic tote second vessel back 403 are configured to align and securely couple with the cubic tote first snap portions 220 of the cubic tote second compartment 210. The second snap portions 401 on the cubic tote second vessel first side 407 and cubic tote second vessel second side 408 are configured to align and securely couple with the receiver portions 311 of the cubic tote first vessel 300 and the receiver portions 511 of the cubic tote third vessel 500.

The cubic tote second vessel lid 402 is removably coupled to the cubic tote second vessel top 406. When coupled, the cubic tote second vessel lid 402 provides for contents of the cubic tote second vessel 400 to be secure and not to exit therefrom. The contents are preferably a bleach. The bleach preferably is a gel bleach, but other types of bleaches are hereby contemplated, including, but not limited to: traditional liquid, powder, etc.

Optionally and/or additionally, the cubic tote second vessel front 405 has a cubic tote second vessel descriptor 410. The cubic tote second vessel descriptor 410 is preferably "Bleach"; however, any other descriptor has been contemplated by this application.

The cubic tote third vessel 500 preferably is a rectangular prism having a height of nineteen inches (19 in.); however, other heights are hereby contemplated, including, but not limited to: eighteen inches (18 in.), twenty inches (20 in.), etc. The cubic tote third vessel 500 preferably has a length of twelve inches (12 in.); however, other lengths are hereby contemplated, including, but not limited to: ten inches (10 in.), fourteen inches (14 in.), etc. The cubic tote third vessel 500 preferably has a width of four inches (4 in.); however, other widths are hereby contemplated, including, but not limited to: three inches (3 in.), five inches (5 in.), etc. The cubic tote third vessel 500 is preferably made of a hard-plastic material, however other materials are hereby contemplated, including, but not limited to: PVC, aluminum, etc.

The cubic tote third vessel 500 further has a cubic tote third vessel lid 502, a cubic tote third vessel back 503, a cubic tote third vessel bottom 504, a cubic tote third vessel front 505, a cubic tote third vessel top 506, a cubic tote third vessel first side 507, and a cubic tote third vessel second side 508. A plurality of cubic tote third vessel second snap portions 501 are configured to be coupled to the cubic tote third vessel bottom 504 and on the cubic tote third vessel back 503. A plurality of cubic tote third vessel receiver portions 511 are located on the cubic tote third vessel second side 508. The second snap portions 501 on the cubic tote third vessel bottom 504 and cubic tote third vessel back 503 are configured to align and securely couple with the cubic tote first snap portions 220 of the cubic tote third compartment 211. The receiver portions 511 on the cubic tote third vessel second side 508 are configured to align and securely couple with the second snap portions 401 of the cubic tote second vessel 400.

The cubic tote third vessel lid 502 is removably coupled to the cubic tote third vessel top 506. When coupled, the cubic tote third vessel lid 502 provides for contents of the cubic tote third vessel 500 to be secure and not to exit therefrom. The contents are preferably a fabric softener. The fabric softener preferably is a liquid, but other types of fabric softeners are hereby contemplated, including, but not limited to: powder, etc.

Optionally and/or additionally, the cubic tote third vessel front 505 has a cubic tote third vessel descriptor 510. The cubic tote third vessel descriptor 510 is preferably "Fabric Softener"; however, any other descriptor has been contemplated by this application.

Referring now to FIGS. 4-6, an illustrated view of an exemplary alternate multi-purpose laundry tote 150 for carrying laundry supplies is presented. When completely assembled (as seen in FIGS. 5 and 6), it has a general overall cubic shape at the bottom that tapers upwards at the outer sections and herein will be described as the alternate tote 150. The alternate tote 150 is useful for providing a secure handling of the laundry supplies when being transported to a from a laundry facility and is further useful for providing an efficient method to have laundry supplies available when doing laundry without having additional effort made to obtain the laundry supplies and to prevent the laundry supplies from being spilled on clothing, the floor, into the laundry washer, etc. As such, the alternate tote 150 operates and functions in much the same manner as the cubic tote 100.

The alternate tote 150 has an alternate tote container 250, an alternate tote first vessel 350, an alternate tote second vessel 450 and an alternate tote third vessel 550. The alternate tote container 250 preferably has a length of twelve inches (12 in.); however other lengths are hereby contemplated, including, but not limited to: ten inches (10 in.), eighteen inches (18 in.), etc. The alternate tote container 250 preferably has a width of twelve inches (12 in.); however other widths are hereby contemplated, including, but not limited to: ten inches (10 in.), eighteen (18) inches, etc. The alternate tote container 250 of the alternate tote 150 is preferably a rectangular prism shape; however other shapes are hereby contemplated, including but not limited to: cubic, trapezoidal, etc. and represent different embodiments of the overall invention. The alternate tote container 250 preferably has a length of twelve inches (12 in.), however other lengths are hereby contemplated, including, but not limited to: ten inches (10 in.), eighteen inches (18 in.), etc. The alternate tote container 250 is preferably made of a hard-plastic material; however other materials are hereby contemplated, including, but not limited to, poly-vinyl chloride (PVC), aluminum, etc.

The alternate tote container 250 has an alternate tote container front 251, an alternate tote container first side 252, an alternate tote container second side 253, an alternate tote container back bottom section 254*a*, an alternate container back top section 254*b*, an alternate tote container bottom 255, an alternate tote container interior 256, an alternate tote carrying strap 257, an alternate tote drawer 258 and a plurality of alternate tote compartments (first compartment) 259, (second compartment) 260, (third compartment) 261. The alternate tote container front 251 is preferably one inch (1 in.) in height; however other heights are hereby contemplated, including but not limited to, one-half inch (½ in.), one-and-a-half inches (1½ in.), etc. The combined height of the alternate tote container back bottom and tope sections 254*a*, 254*b* preferably has a height of nineteen inches (19 in.), however other heights are hereby contemplated, including, but not limited to, sixteen inches (16 in.), twenty inches (20 in.), etc.

An alternate tote strap first end 262 of the alternate tote strap 257 is removably coupled to the alternate tote container first side 252 by an alternate tote first coupling device 264. An alternate tote strap second end 265 of the alternate tote strap 257 is removably coupled to the alternate tote container second side 253 by an alternate tote second coupling device 267. The alternate tote strap 257 is preferably made of a vinyl material; however, other materials are hereby contemplated, including, but not limited to: plastic, cloth, etc.

The alternate tote drawer 258 is accessible from the alternate tote container front 251. Centrally located on the front surface of the alternate tote drawer 258 is an alternate tote drawer handle 268. The alternate tote drawer 258 is preferably slidably retained within the alternate tote container front 251 with a pair of alternate tote drawer slides 269, each located on the inner surfaces of the alternate tote container front 251. Other means of slidably attaching or otherwise removably affixing the alternate tote drawer 258 to the alternate tote container front 251 can include a hinge coupler, etc. The alternate tote drawer 258 preferably holds fabric softener sheets; however, other items to be held are hereby contemplated, including, but not limited to: clothespins, buttons, etc. Optionally and/or additionally, the front surface of the alternate tote drawer 258 has an alternate tote drawer descriptor 272. The alternate tote drawer descriptor 272 is preferably "Dryer Sheets", however any other type of indicia has been contemplated by this application.

The plurality of alternate tote compartments 259, 260, 261 are configured in the alternate tote interior 258. Each of the alternate tote compartments 259, 260, 261 have a plurality of alternate tote first snap portions 270. An individual alternate tote first snap portion 270 can receive and mate with an individual second snap portion 351, 451, 551 of the alternate tote first vessel 350, the alternate tote second vessel 450, and the alternate tote third vessel 550, respectively. The alternate tote first vessel 350 resides within the alternate tote first compartment 259, the alternate tote second vessel 450 resides within the alternate tote second compartment 260, and the alternate tote third vessel 550 resides within the alternate tote third compartment 261.

The alternate tote first vessel 350 is preferably a bottle-shaped device, having a bottom section relatively shaped as a rectangular prism and tapering upwards to an open top favoring a leftmost side (i.e., an alternate tote first vessel first side 357). The alternate tote first vessel 350 preferably has a height of nineteen inches (19 in.); however, other heights are hereby contemplated, including, but not limited to: eighteen inches (18 in.), twenty inches (20 in.), etc. The alternate tote first vessel 350 preferably has a length of twelve inches (12 in.); however, other lengths are hereby contemplated, including, but not limited to: ten inches (10 in.), fourteen inches (14 in.), etc. The alternate tote first vessel 350 preferably has a width of four inches (4 in.); however, other widths are hereby contemplated, including, but not limited to: three inches (3 in.), five inches (5 in.), etc. The alternate tote first vessel 350 is preferably made of a hard-plastic material; however other materials are hereby contemplated, including, but not limited to: PVC, aluminum, etc.

The alternate tote first vessel 350 further has an alternate tote first vessel lid 352, an alternate tote first vessel back 353, an alternate tote first vessel bottom 354, an alternate tote first vessel front 355, an alternate tote first vessel top 356, the alternate tote first vessel first side 357, and an alternate tote first vessel second side 358. A plurality of alternate tote first vessel second snap portions 351 is configured to be coupled to the alternate tote first vessel bottom 354, on the alternate tote first vessel back 353, and on the alternate tote first vessel second side 358. The second snap portions 351 on the alternate tote first vessel bottom 354 and alternate tote first vessel back 353 are configured to align and securely couple with the alternate tote first snap portions 270 of the alternate tote first compartment 259. The second snap portions 351 on the alternate tote first vessel second side 358 are configured to align and securely couple with the second snap portions 451 of the alternate tote second vessel 450.

The alternate tote first vessel lid 352 is removably coupled to a spout of the tapered portion of the alternate tote first vessel top 356. When coupled, the alternate tote first vessel lid 352 provides for contents of the alternate tote first vessel 350 to be secure and not to exit therefrom. The contents are preferably a detergent. The detergent preferably is a liquid detergent, but other types of detergent are hereby contemplated, including, but not limited to: "pods", powder, etc. The alternate tote first vessel 350 is capable of being removable from the alternate tote container 250.

Optionally and/or additionally, the alternate tote first vessel front 355 has an alternate tote first vessel descriptor 360. The alternate tote first vessel descriptor 360 is preferably "Detergent"; however, any other descriptor has been contemplated by this application.

The alternate tote second vessel 450 is preferably a conical or pyramidal prism having a height of ten inches (19 in.); however, other heights are hereby contemplated, including, but not limited to: nine inches (9 in.), eleven inches (11 in.), etc. The alternate tote second vessel 450 preferably has a length of twelve inches (12 in.); however, other lengths are hereby contemplated, including, but not limited to: ten inches (10 in.), fourteen inches (14 in.), etc. The alternate tote second vessel 450 preferably has a width of four inches (4 in.); however, other widths are hereby contemplated, including, but not limited to: three inches (3 in.), five inches (5 in.), etc. The alternate tote second vessel 450 is preferably made of a hard-plastic material; however, other materials are hereby contemplated, including, but not limited to: PVC, aluminum, etc.

The alternate tote second vessel 450 further has an alternate tote second vessel lid 452, an alternate tote second vessel back 453, an alternate tote second vessel bottom 454, an alternate tote second vessel front 455, an alternate tote second vessel top 456, an alternate tote second vessel first side 457, and an alternate tote second vessel second side 458. A plurality of alternate tote second vessel second snap portions 451 is configured to be coupled to the alternate tote second vessel bottom 404, on the alternate tote second vessel back 453, on the alternate tote second vessel first side 457, and on the alternate tote first vessel second side 458. The second snap portions 451 on the alternate tote second vessel back 453 are configured to align and securely couple with the alternate tote first snap portions 270 of the alternate tote second compartment 260. The second snap portions 451 on the alternate tote second vessel first side 457 and alternate tote second vessel second side 458 are configured to align and securely couple with the second snap portions 351 of the alternate tote first vessel 350 and the second snap portions 551 of the alternate tote third vessel 550.

The alternate tote second vessel lid 452 is removably coupled to a spout portion of the alternate tote second vessel top 456. When coupled, the alternate tote second vessel lid 452 provides for contents of the alternate tote second vessel 450 to be secure and not to exit therefrom. The contents are preferably a bleach. The bleach preferably is a gel bleach, but other types of bleaches are hereby contemplated, including, but not limited to: traditional liquid, powder, etc.

Optionally and/or additionally, the alternate tote second vessel front 455 preferably has an alternate tote second vessel descriptor 460. The alternate tote second vessel descriptor 460 is preferably "Bleach"; however, any other descriptor has been contemplated by this application.

The alternate tote third vessel 550 is preferably a bottle-shaped device, having a bottom section relatively shaped as a rectangular prism and tapering upwards to an open top favoring a rightmost side (i.e., an alternate tote third vessel second side 558). As such, the alternate tote third vessel 550 is a mirror image of the alternate tote first vessel 350. The alternate tote third vessel 550 preferably has a height of nineteen inches (19 in.); however, other heights are hereby contemplated, including, but not limited to: eighteen inches (18 in.), twenty inches (20 in.), etc. The alternate tote third vessel 550 preferably has a length of twelve inches (12 in.); however, other lengths are hereby contemplated, including, but not limited to: ten inches (10 in.), fourteen inches (14 in.), etc. The alternate tote third vessel 550 preferably has a width of four inches (4 in.); however, other widths are hereby contemplated, including, but not limited to: three inches (3 in.), five inches (5 in.), etc. The alternate tote third vessel 550 is preferably made of a hard-plastic material, however other materials are hereby contemplated, including, but not limited to: PVC, aluminum, etc.

The alternate tote third vessel 550 further has an alternate tote third vessel lid 552, an alternate tote third vessel back 553, an alternate tote third vessel bottom 554, an alternate tote third vessel front 555, an alternate tote third vessel top 556, an alternate tote third vessel first side 557, and the alternate tote third vessel second side 558. A plurality of alternate tote third vessel second snap portions 551 are configured to be coupled to the alternate tote third vessel bottom 554, on the alternate tote third vessel back 553, and on the alternate tote third vessel first side 557. The second snap portions 501 on the alternate tote third vessel bottom 574 and alternate tote third vessel back 573 are configured to align and securely couple with the alternate tote first snap portions 270 of the alternate tote third compartment 261. The second snap portions 551 on the alternate tote third vessel first side 557 are configured to align and securely couple with the second snap portions 401 of the alternate tote second vessel 450.

The alternate tote third vessel lid 552 is removably coupled to a spout of the tapered portion of the alternate tote third vessel top 556. When coupled, the alternate tote third vessel lid 552 provides for contents of the alternate tote third vessel 550 to be secure and not to exit therefrom. The contents are preferably a fabric softener. The fabric softener preferably is a liquid, but other types of fabric softeners are hereby contemplated, including, but not limited to: powder, etc.

Optionally and/or additionally, the alternate tote third vessel front 555 preferably has an alternate tote third vessel descriptor 560. The alternate tote third vessel descriptor 560 is preferably "Fabric Softener"; however, any other descriptor has been contemplated by this application.

Referring now more closely to FIG. 2, it is shown that in a preferred embodiment of the cubic tote 100, the fronts 305, 405, 505 of the respective cubic tote vessels 300, 400, 500 provide a flowing and uninterrupted common perimeter. Similarly illustrated in FIG. 5, it is shown that in tube alternate tote embodiment 150, the fronts 355, 455, 555 of the respective cubic tote vessels 350, 450, 550 provide a flowing and uninterrupted common perimeter.

In the numbered clauses below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

The features described with respect to one embodiment may be applied to other embodiments or combined with or interchanged with the features of other embodiments, as appropriate, without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

The invention claimed is:

1. A cubic multi-purpose laundry tote, comprising:

a cubic tote container having a cubic tote container front, a cubic tote container first side, a cubic tote container second side, a cubic tote container back, a cubic tote container bottom, a cubic tote container interior, a cubic tote carrying strap, a cubic tote drawer, and a plurality of tote compartments, the cubic tote drawer is accessible from the cubic tote container front centrally located on the front surface of the cubic tote drawer and has a cubic tote drawer handle, the cubic tote drawer is slidably retained within the cubic tote container front with a pair of cubic tote drawer slides, each of the pair of cubic tote drawer slides are located on the inner surfaces of the cubic tote container front;

the cubic tote carrying strap having a first end and a second end, the first end of the cubic tote carrying strap is removably coupled to a cubic tote container first side top by a cubic tote first coupling device, the second end of the cubic tote carrying strap is removably coupled to a cubic tote container second side top by a cubic tote second coupling device;

a cubic tote first vessel having a cubic tote first vessel lid, a cubic tote first vessel back, a cubic tote first vessel bottom, a cubic tote first vessel front, a cubic tote first vessel top, a cubic tote first vessel first side, and a cubic tote first vessel second side, a plurality of cubic tote first vessel second snap portions located on the cubic tote first vessel bottom and on the cubic tote first vessel back, a plurality of cubic tote first vessel receiver portions are located on the cubic tote first vessel first side, the second snap portions on the cubic tote first vessel bottom and cubic tote first vessel back are configured to align and securely couple with a cubic tote first snap portions of the cubic tote first compartment, the receiver portions on the cubic tote first vessel first side are configured to align and securely couple with a plurality of cubic tote second vessel second snap portions of a cubic tote second vessel, the cubic tote first vessel lid is removably coupled to the cubic tote first vessel top, when coupled the cubic tote first vessel lid provides for contents of the cubic tote first vessel to be secure and not to exit therefrom, the cubic tote first vessel is capable of being removable from the cubic tote container, the cubic tote first vessel having a rectangular prism;

the cubic tote second vessel having a cubic tote second vessel lid, a cubic tote second vessel back, a cubic tote second vessel bottom, a cubic tote second vessel front, a cubic tote second vessel top, a cubic tote second vessel first side, and a cubic tote second vessel second side, a plurality of cubic tote second vessel second snap portions located on the cubic tote second vessel bottom, on the cubic tote second vessel back, on the cubic tote second vessel first side, and on the cubic tote first vessel second side, the second snap portions on the cubic tote second vessel bottom and cubic tote second vessel back are configured to align and securely couple with a cubic tote first snap portions of the cubic tote second compartment, the second snap portions on the cubic tote second vessel first side and cubic tote second vessel second side are configured to align and securely couple with the receiver portions of the cubic tote first vessel and a receiver portions of a cubic tote third vessel, the cubic tote second vessel lid is removably coupled to the cubic tote second vessel top, when coupled the cubic tote second vessel lid provides for contents of the cubic tote second vessel to be secure and not to exit therefrom, the cubic tote second vessel having a rectangular prism; and the cubic tote third vessel having a cubic tote third vessel lid, a cubic tote third vessel back, a cubic tote third vessel bottom, a cubic tote third vessel front, a cubic tote third vessel top, a cubic tote third vessel first side, and a cubic tote third vessel second side, a plurality of cubic tote third vessel second snap portions located on the cubic tote third vessel bottom and on the cubic tote third vessel back, a plurality of cubic tote third vessel receiver portions are located on the cubic tote third vessel second side, the second snap portions on the cubic tote third vessel bottom and cubic tote third vessel back are configured to align and securely couple with a cubic tote first snap portions of the cubic tote third compartment, the receiver portions on the cubic tote third vessel second side are configured to align and securely couple with the second snap portions of the cubic tote second vessel, the cubic tote third vessel lid is removably coupled to the cubic tote third vessel top, when coupled, the cubic tote third vessel lid provides for contents of the cubic tote third vessel to be secure and not to exit therefrom, the cubic tote third vessel having a rectangular prism.

2. The cubic multi-purpose laundry tote according to claim 1, wherein the cubic tote compartments are configured in the cubic tote interior and each of the cubic tote compartments have a plurality of cubic tote first snap portions, an individual cubic tote first snap portion receives and mates with an individual second snap portion of the cubic tote first vessel, the cubic tote second vessel, and the cubic tote third vessel respectively.

3. The cubic multi-purpose laundry tote according to claim 1, wherein the cubic tote first vessel resides within the cubic tote first compartment, the cubic tote second vessel resides within the cubic tote second compartment, and the cubic tote third vessel resides within the cubic tote third compartment.

4. The cubic multi-purpose laundry tote according to claim 1, wherein the cubic tote container is made of material selected from the group consisting of hard-plastic, poly-vinyl chloride, or aluminum.

5. The cubic multi-purpose laundry tote according to claim 1, wherein the front surface of the cubic tote drawer has a cubic tote drawer descriptor.

6. The cubic multi-purpose laundry tote according to claim 1, wherein the cubic tote carrying strap is a strap made of material selected from the group consisting of vinyl, plastic, and cloth.

7. The cubic multi-purpose laundry tote according to claim 1, wherein the cubic tote first vessel is made of material selected from the group consisting of hard-plastic, poly-vinyl chloride, or aluminum.

8. The cubic multi-purpose laundry tote according to claim 1, wherein the cubic tote first vessel has a cubic tote drawer descriptor.

9. The cubic multi-purpose laundry tote according to claim 1, wherein the cubic tote second vessel has a cubic tote drawer descriptor.

10. The cubic multi-purpose laundry tote according to claim 1, wherein the cubic tote third vessel has a cubic tote drawer descriptor.

11. The cubic multi-purpose laundry tote according to claim 1, wherein the cubic tote second vessel lid is removably coupled to a spout of a tapered portion of the cubic tote second vessel top.

12. The cubic multi-purpose laundry tote according to claim 1, wherein the cubic tote third vessel lid is removably coupled to a spout of a tapered portion of the cubic tote third vessel top.

13. The cubic multi-purpose laundry tote according to claim 1, wherein the cubic tote container has a length selected from the group consisting of 10 inches, 12 inches, or 18 inches.

14. The cubic multi-purpose laundry tote according to claim 1, wherein the cubic tote container has a width selected from the group consisting of 10 inches, 12 inches, or 18 inches.

15. The cubic multi-purpose laundry tote according to claim 1, wherein the cubic tote container has a height selected from the group consisting of 16 inches, 19 inches, or 20 inches.

* * * * *